US009419387B2

(12) United States Patent
Jin et al.

(10) Patent No.: US 9,419,387 B2
(45) Date of Patent: Aug. 16, 2016

(54) PLUG FOR DC APPLIANCE

(75) Inventors: Hyun Cheol Jin, Hwaseong-si (KR); Han Sol Seo, Seoul (KR); Hyun Soo Park, Seoul (KR); Byoung Kuk Lee, Yongin-si (KR); Joon Young Jeon, Suwon-si (KR)

(73) Assignees: SAMSUNG ELECTRONICS CO., LTD., Suwon-Si (KR); SUNGKYUNKWAN UNIVERSITY, Suwon-Si (KR)

( * ) Notice: Subject to any disclaimer, the term of this patent is extended or adjusted under 35 U.S.C. 154(b) by 916 days.

(21) Appl. No.: 13/348,163

(22) Filed: Jan. 11, 2012

(65) Prior Publication Data

US 2012/0200280 A1 Aug. 9, 2012

(30) Foreign Application Priority Data

Feb. 9, 2011 (KR) ..... 10-2011-0011412

(51) Int. Cl.
*H01R 24/28* (2011.01)
*H01R 13/66* (2006.01)
*H01R 103/00* (2006.01)

(52) U.S. Cl.
CPC ..... *H01R 24/28* (2013.01); *H01R 13/6666* (2013.01); *H01R 2103/00* (2013.01)

(58) Field of Classification Search
CPC ..... H05K 5/0247; H01C 7/12; H01R 24/28; H01R 13/6666; H01R 2103/00
USPC ..... 307/82; 439/181, 312; 323/304; 361/10, 361/18, 58, 118
See application file for complete search history.

(56) References Cited

U.S. PATENT DOCUMENTS 5,264,988 A * 11/1993 Masaki ..... H05B 39/02 361/10
5,777,868 A 7/1998 Gibboney, Jr.
2003/0030328 A1 * 2/2003 Tamai et al. ..... 307/82

FOREIGN PATENT DOCUMENTS

CN 1260081 7/2000
CN 201117979 9/2008

(Continued)

OTHER PUBLICATIONS

Extended European Search Report dated May 7, 2012 issued in corresponding European Patent Application No. 12154591.7.
European Office Action issued Feb. 19, 2015 in corresponding European Patent Application No. 12154591.7.

(Continued)

*Primary Examiner* — Gary L Laxton
*Assistant Examiner* — Jye-June Lee
(74) *Attorney, Agent, or Firm* — Staas & Halsey LLP

(57) ABSTRACT

A plug for a DC appliance includes an input unit including anode and cathode terminals, an output unit including anode and cathode terminals to allow a DC current input through the input unit to be output to an electric device, a connection unit to interconnect the input unit and the output unit, a rectifier unit coupled between anode and cathode terminals of the input unit to rectify the input DC current, an inductor unit connected in series to the rectifier unit so that an internal current of the plug is gradually increased in response to an increase of the input DC current, and a condenser unit connected in series to the inductor unit, which is charged with voltage in response to a current passing through the inductor unit, and discharges the charged voltage to the output unit when the input of the DC current from the input unit is interrupted.

4 Claims, 10 Drawing Sheets

(56) References Cited

FOREIGN PATENT DOCUMENTS

| | | | |
|---|---|---|---|
| CN | 201466359 | | 5/2010 |
| JP | 2010153368 A | * | 7/2010 |

OTHER PUBLICATIONS

Chinese Office Action issued Mar. 27, 2015 in corresponding Chinese Patent Application No. 201210024994.1.

* cited by examiner

-PRIOR ART-

PLUG FOR DC APPLIANCE

CROSS-REFERENCE TO RELATED APPLICATIONS

This application claims the benefit of Korean Patent Application No. 10-2011-0011412, filed on Feb. 9, 2011 in the Korean Intellectual Property Office, the disclosure of which is incorporated herein by reference.

BACKGROUND

1. Field

Embodiments of the present disclosure relate to a plug for a DC appliance for safely supplying DC power to an electric device.

2. Description of the Related Art

Conventionally, power has been supplied to household appliances or electric devices of a general home by an AC power distribution system providing commercial power. The AC power distribution system supplies power to electric devices using a plug, a socket, a switch, etc. The electric device having received AC power converts AC power into DC power using a rectifier embedded therein. Typically, the AC power distribution system does not include a device for preventing arc from being generated in plug separation.

However, in the future, it is expected that the demand of a general home which desires to use DC power using a solar battery, a fuel cell, etc. will be rapidly increasing. DC power can reduce energy loss generated when a conventional AC power distribution system converts AC power into DC power. In the case of using AC power, provided that a unique power factor of a device is bad or poor although the device has the same power consumption, a generation end has to generate as much power as reactive power, resulting in energy inefficiency. Further, DC power can be easily stored, so that it can effectively cope with an emergency situation.

Due to these disadvantages, the number of household appliances including an inverter is rapidly increasing, and most digital devices use DC power.

Therefore, a plug suitable for DC power distribution is needed. The conventional DC power plug is identical in structure to the AC power plug, so that an in-rush current occurs in power distribution or an arc occurs in an unplugging operation, resulting in safety problems.

SUMMARY

Therefore, it is an aspect of the present disclosure to provide a plug for a DC appliance which includes a rectifier unit and a condenser unit to prevent arc from being generated in an unplugging operation.

It is another aspect of the present disclosure to provide a plug for a DC appliance which includes an inductor unit to prevent an in-rush current from being generated in power distribution.

Additional aspects of the disclosure will be set forth in part in the description which follows and, in part, will be apparent from the description, or may be learned by practice of the disclosure.

In accordance with one aspect of the present disclosure, a plug for a DC appliance includes an input unit including anode and cathode terminals inserted into a socket so as to receive a DC current; an output unit including anode and cathode terminals so as to allow the DC current input through the input unit to be output to an electric device; a connection unit including anode and cathode lines so as to interconnect the input unit and the output unit; a rectifier unit coupled between anode and cathode terminals of the input unit so as to rectify the input DC current; an inductor unit that is connected in series to the rectifier unit in such a manner that an internal current of the plug is gradually increased in response to an increase of the input DC current; and a condenser unit that is connected in series to the inductor unit, is charged with voltage in response to a current passing through the inductor unit, and discharges the charged voltage to the output unit when the input of the DC current from the input unit is interrupted.

The rectifier unit may flow back a current present in the plug to the output unit when the DC current input is stopped by the input unit disconnected from the socket, thereby preventing an arc phenomenon generated when the current is leaked to outside of the plug.

The rectifier unit may be coupled to cathode and anode terminals of the input unit, and may be coupled to anode and cathode terminals of the input unit so that a current present in the plug flows from the input unit to the output unit.

One terminal of the inductor unit may be coupled to the cathode of the rectifier, and other terminal thereof may be coupled to the condenser unit.

The inductor unit may prevent an internal current of the plug from being rapidly increased when the input unit is inserted into the socket and the DC current input is increased, thereby preventing flow of an in-rush current.

Inductance of the inductor unit may be adjusted in such a manner that an internal current of the plug is increased with an appropriate speed.

The condenser unit may reduce a voltage difference between the input unit and the output unit when the DC current input is stopped by the input unit disconnected from the socket, thereby preventing an arc phenomenon.

The condenser unit may be coupled between anode and cathode terminals of the output unit in such a manner that the charged voltage is discharged to the output unit when the input unit is disconnected from the socket.

Capacitance of the condenser unit may be adjusted in such a manner that the voltage difference between the input unit and the output unit is maintained within a predetermined range for a predetermined time beginning from a specific time where the input unit is disconnected from the socket.

In accordance with another aspect of the present disclosure, a plug for a DC appliance includes an input unit including anode and cathode terminals inserted into a socket so as to receive a DC current; an output unit including anode and cathode terminals so as to allow the DC current input through the input unit to be output to an electric device; a connection unit including anode and cathode lines so as to interconnect the input unit and the output unit; a rectifier unit coupled between anode and cathode terminals of the input unit so as to rectify the input DC current; a condenser unit that is connected in parallel to the rectifier unit, is charged with voltage in response to the rectified current, and discharges the charged voltage to the output unit when the input of the DC current from the input unit is interrupted; and an inductor unit that is connected in series to the rectifier unit and the condenser unit connected in parallel to each other, thereby gradually increasing an internal current of the plug when the DC current from the input unit is increased.

The rectifier unit may flow back a current present in the plug to the output unit when the DC current input is stopped by the input unit disconnected from the socket, thereby preventing an arc phenomenon generated when the current is leaked to outside of the plug.

The rectifier unit may connect its own cathode terminal to the anode line, and may connect its own anode terminal to the cathode line so that a current present in the plug flows from the input unit to the output unit.

The condenser unit may reduce a voltage difference between the input unit and the output unit when the DC current input is stopped by the input unit disconnected from the socket, thereby preventing an arc phenomenon.

Capacitance of the condenser unit may be adjusted in such a manner that the voltage difference between the input unit and the output unit is maintained within a predetermined range for a predetermined time beginning from a specific time where the input unit is disconnected from the socket.

The inductor unit may prevent an internal current of the plug from being rapidly increased when the input unit is inserted into the socket and the DC current input is increased, thereby preventing flow of an in-rush current.

Inductance of the inductor unit may be adjusted in such a manner that an internal current of the plug is increased with an appropriate speed.

One terminal of the inductor unit may be coupled to an anode terminal of the input unit, and other terminal thereof may be coupled to the rectifier unit and the condenser unit connected in parallel to each other.

The other terminal of the inductor unit may be coupled to a cathode terminal of the rectifier unit, and may be also connected to the anode line.

The condenser unit may be coupled between anode and cathode terminals of the output unit in such a manner that the charged voltage is discharged to the output unit when the input unit is disconnected from the socket and the DC current input is thus stopped.

One terminal of the inductor unit may be coupled to an anode terminal of the output unit, and other terminal thereof may be coupled to the rectifier unit and the condenser unit connected in parallel to each other.

A cathode terminal of the rectifier unit may be coupled to an anode terminal of the input unit, and an anode terminal thereof may be coupled to the cathode terminal of the input unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
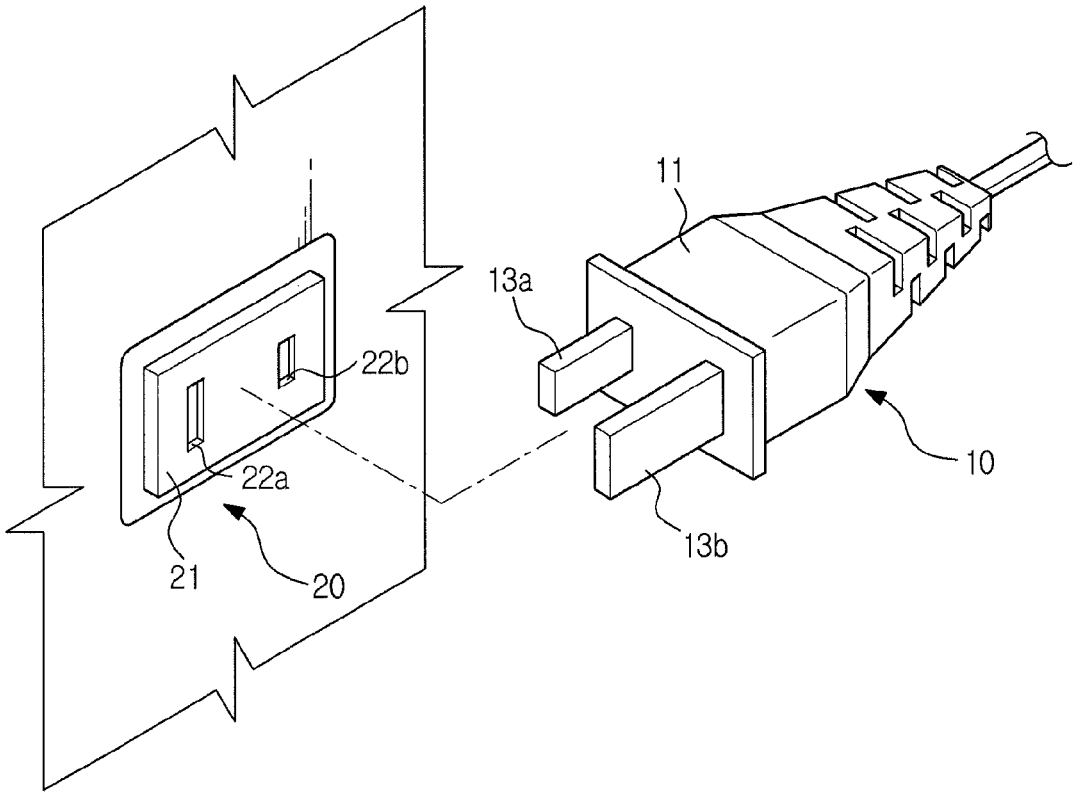
FIG. 1 is a perspective view illustrating a plug for a DC appliance and a socket according to one embodiment of the present disclosure.

Reference will now be made in detail to the embodiments of the present disclosure, examples of which are illustrated in the accompanying drawings, wherein like reference numerals refer to like elements throughout.

FIG. 1 is a perspective view illustrating a plug for a DC appliance and a socket according to one embodiment of the present disclosure.

Referring to FIG. 1, a plug 10 for a DC appliance (hereinafter referred to as a DC-appliance plug) includes a plug housing 11, one pair of through-holes formed at one side of the plug housing 11, and one pair of connectors 13*a* and 13*b* installed at the through-holes and protruded outside.

The DC-appliance plug 10 according to the embodiment of the present disclosure is detachably connected to the socket 20, and is inserted into the socket 20, such that it receives DC current.

One pair of insertion holes 22*a*, 22*b* is arranged at one surface of the socket housing 21 of the socket 20. A positive-pole (i.e., anode) contact and a negative-pole (i.e., cathode) contact are arranged the insertion holes 22*a* and 22*b*, respectively. An anode wire and a cathode wire are coupled to the anode contact and the cathode contact, respectively.

In the case where the connectors 13*a*,13*b* of the plug 10 are inserted into the insertion holes 22*a*,22*b* of the socket and both contacts of the socket 20 are coupled to the connectors 13*a*,13*b* of the plug 10, DC current received from the external part is applied to the connectors 13*a*,13*b* of the plug 10.

In order to prevent the plug 10 from being wrongly coupled to an anode and a cathode of the socket 20, the plug 10 according to the embodiment includes different sizes of the anode and the cathode in such a manner that the anode and the cathode can be distinguished from each other. If necessary, the anode and the cathode may be distinguished from each other in different ways.

For example, provided that a user may make a distinction between an anode and a cathode of the plug by viewing an anode terminal and a cathode terminal arranged in the form of L-shape or by viewing different shapes of the anode and cathode, the above plug may be used as a DC-appliance plug 10. In addition, a 3-terminal plug 10 comprised of an anode terminal, a cathode terminal, and a ground or guide terminal may be used as necessary.

In the case where the DC-appliance plug 10 is plugged in the socket 20 so that DC power is applied to the plug 10, an in-rush current higher than a normal current may occur due to a condenser, etc. present in the electric device. Such in-rush current may apply impact to the electric device, resulting in a malfunction or a shortened lifetime of the electric device.

Although the conventional AC power distribution system limits such in-rush current using a relay, the DC power distribution system does not include a small-sized DC relay, so that a separate structure for preventing overcurrent is needed.

In addition, when the DC-appliance plug 10 inserted into the socket 20 is separated (i.e., when the DC-appliance plug 10 is unplugged), arc may be generated by parasitic capacitance of an electric line and inductance of a load device. In more detail, because a current, that remains in the plug 10 without flowing to the electric device when the plug 10 is unplugged, is discharged to the outside, the arc phenomenon is generated.

In the conventional AC power distribution system, a voltage periodically reaches zero '0' and thus the arc phenomenon may be prevented from being generated, but a point at which a DC voltage is set to zero '0' is not present in the conventional DC power distribution system, so that arc is continuously generated. If the arc phenomenon is continuously generated, the electric device may be instantaneously damaged, durability of conductive lines may be adversely affected, thereby causing a variety of electric shock accidents and a fire.

The circuit diagram of the DC-appliance plug that prevents an in-rush current from being generated in the plug-in operation simultaneously while preventing the arc phenomenon from being generated in the plug-out operation will hereinafter be described with reference to the annexed drawings.

Figure 2:
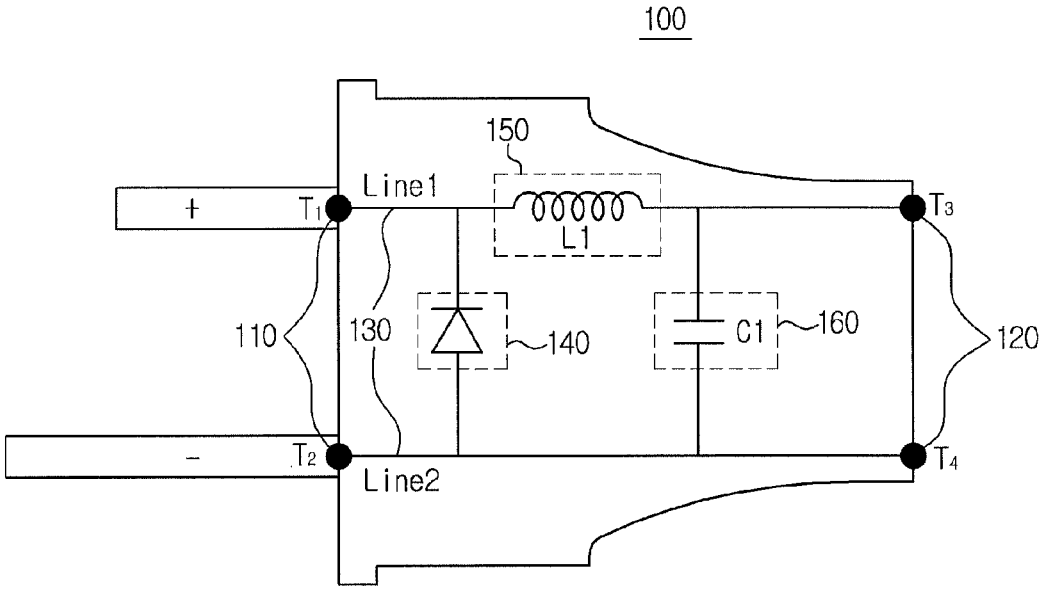
FIG. 2 is a circuit diagram illustrating a plug for a DC appliance according to one embodiment of the present disclosure.

FIG. 2 is a circuit diagram illustrating a plug for a DC appliance according to one embodiment of the present disclosure.

Referring to FIG. 2, a plug 100 for a DC appliance includes an input unit 110 to receive a DC current, an output unit 120 to output the received DC current, a connection unit 130 to couple the input unit 110 to the output unit 120, a rectifier unit 140, an inductor unit 150, and a condenser unit 160.

The input unit 110 includes an anode terminal T1 and a cathode terminal T2 located below the anode terminal T1, so that it is detachably coupled to the socket. That is, the input unit 110 is inserted into the socket so as to receive a DC current from the external part.

The input DC current is output through the output unit 120 that includes an anode terminal T3 and a cathode terminal T4 located below the anode terminal T1, so that it is used to operate the electric device.

The connection unit 130 includes an anode line (Line1) and a cathode line (Line2) located below the anode line (Line1) so as to interconnect the input unit 110 and the output unit 120.

The connection unit 130 is coupled to the rectifier unit 140, the inductor unit 150, and the condenser unit 160, and allows the input DC current to be output to the output unit 120.

The rectifier unit 140 acting as a diode may interconnect the anode terminal T1 and the cathode terminal T2 of the input unit 110. In more detail, an anode terminal of the rectifier unit 140 is coupled to the cathode terminal T2 of the input unit 110, and the cathode terminal is coupled to the anode terminal T1 of the input unit 110.

The rectifier unit 140 may perform rectifying of an internal current of the plug 100 in such a manner that the internal current of the plug 100 can flow to a specific direction. The rectifier unit 140 allows an internal current of the plug 100 to flow from the input unit 110 to the output unit 120. As a result, it is prevented that a current, that remains in the plug 100 in case of the plug-out operation, is leaked to the outside through the input unit 110. Detailed operations of the current leakage prevention effect caused by the rectifier unit 140 will be given below.

The inductor unit 150 may include an inductor serially connected to the rectifier unit 140. The inductor unit 150 is coupled to the cathode terminal of the rectifier unit 140, and is coupled to the anode line (Line1).

The inductor acting as a circuit element may include a coil that induces a voltage in proportion to a current variation, so that it can perform current charging. The inductor prevents an internal current of the plug from being abruptly changed.

Meanwhile, although the inductor unit 150 of the embodiment is shown with only one inductor for convenience of description, the scope or spirit of the inductor unit 150 is not limited thereto. If necessary, in order to properly adjust inductance (L1), the inductor unit 150 may also include a plurality of inductors connected in series or in parallel to each other without departing from the scope or spirit of the present disclosure.

The condenser unit 160 includes a condenser connected in series to the inductor unit 150. In addition, the condenser unit 160 may be coupled between a third terminal T3 and a fourth terminal T4 of the output unit 120.

From the beginning of the plug-in operation, the condenser unit 160 is charged with a voltage in response to a current passing through the inductor unit 150. then, the voltage charged in the condenser unit 160 is discharged to the output unit 120 for a predetermined period of time from the beginning of the plug-out operation.

Although the condenser unit 160 of the embodiment includes only one condenser for convenience of description, the scope or spirit of the condenser unit 160 is not limited thereto. If necessary, in order to properly adjust capacitance (C1) of the condenser unit 160, the condenser unit 160 may also include a plurality of condensers connected in series or in parallel without departing from the scope or spirit of the present invention.

The DC-appliance plug to safely output a DC current by preventing the problem that may be encountered at an abrupt change point of the input DC current will hereinafter be described with reference to the annexed drawings.

The abrupt change time point of the input DC current is any of a plug-in time point and a plug-out time point.

The DC-appliance plug 100 for preventing an in-rush current caused by the plug-in operation according to the embodiment of the present disclosure will hereinafter be described.

The DC-appliance plug 100 according to the embodiment of the present disclosure includes the inductor unit 150 so as to prevent an in-rush current from being generated.

In more detail, the amount of a current flowing in the inductor 150 in case of the plug-in operation is abruptly increased. The increased in-rush current means that magnetic flux induced to the inside of the inductor unit 150 is increased, and the inductor unit 150 restricts the increasing magnetic flux until the magnetic flux is saturated. That is, the inductor unit 150 restricts magnetic flux saturation such that it prevents a current flowing in the inductor unit 150 from being rapidly increased.

Figure 3:
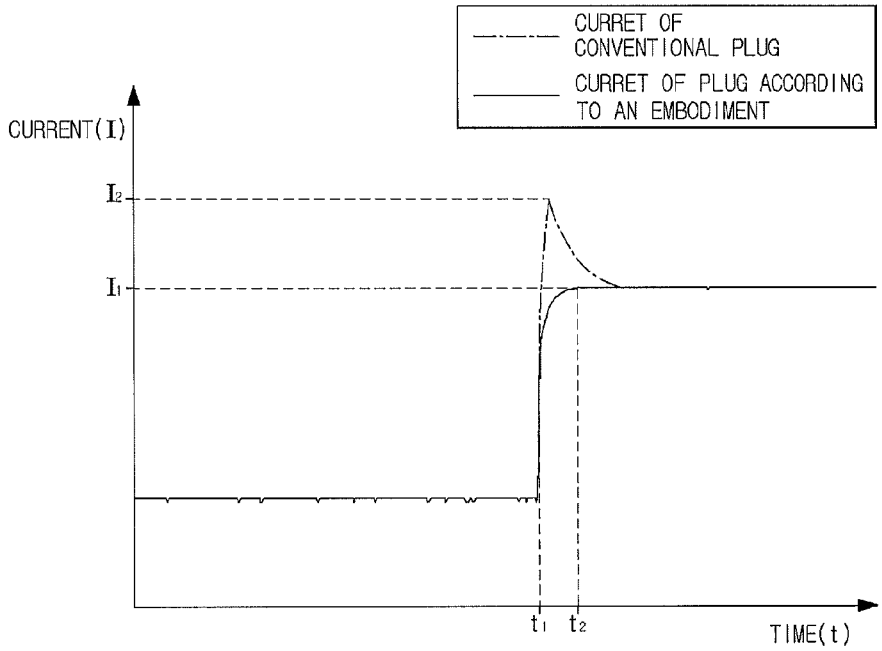
FIG. 3 shows a current changing with time at a plug for a DC appliance including an overcurrent prevention circuit.

FIG. 3 shows a current changing with time at a plug for a DC appliance in case of the plug-in operation.

Referring to FIG. 3, a current flowing in the plug is increased in case of the plug-in operation. A current (denoted by a chain line) of a plug having no inductor unit may be abruptly increased in the plug-in operation ($t_1$), so that an in-rush current $I_2$ higher than a normal current $I_1$ flows and is converged into a normal current according to the lapse of time.

In contrast, a current (denoted by a solid line) of a plug having the inductor unit is linearly increased for a predetermined time ($t_2-t_1$) from the beginning of the plug-in time ($t_1$). In more detail, a current of the DC-appliance plug having the inductor unit is gradually increased to a normal current ($I_1$) for a predetermined time ($t_2-t_1$), and is constantly maintained from the time ($t_2$) at which the current reaches the normal current ($I_1$).

In other words, the inductor unit linearly increases a current of the circuit until the current reaches a saturation current indicating a chargeable threshold value. If the current reaches the saturation current, the inductor unit serves as a conductive line.

As a result, the DC-appliance plug according to the embodiment of the present disclosure may prevent an in-rush current from being generated in the plug-in operation.

The DC-appliance plug that prevents arc from being generated in the plug-out operation according to the embodiment of the present disclosure will hereinafter be described in detail.

The DC-appliance plug 100 includes a rectifier unit 140 and a condenser unit 160 so as to prevent the above-mentioned arc from being generated.

The rectifier unit 140 rectifies a residual current of the plug 100 in a predetermined direction in case of the unplugging operation, so that it can prevent current leakage from being generated.

In addition, the condenser unit 160 reduces a difference in voltage between the input unit 110 and the output unit 120 of the plug 100 in case of the unplugging operation, so that it can be used as a supplementary means for the arc prevention effect.

The flow of an internal current of the plug 100 including the rectifier unit 140 and the condenser unit 160 and the arc-phenomenon prevention effect will hereinafter be described with reference to FIGS. 4A and 4B.

Figure 4A:
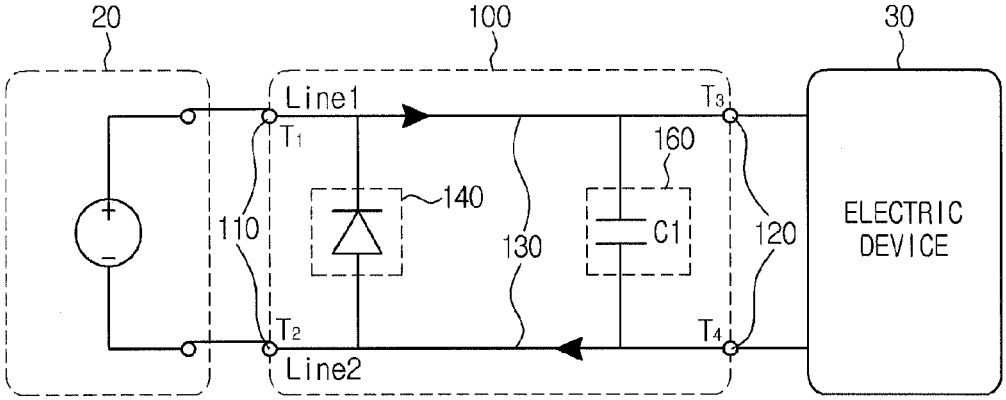
FIG. 4A shows the flow of current in a current-leakage prevention circuit in case of a plug-in operation.

Referring to FIG. 4A, if the plug 100 is inserted into the socket 20, an electric current is applied to an anode line (Line1) and a cathode line (Line2) of the plug 100, such that a DC voltage is applied from the input unit 110 to the output unit 120. The DC voltage is supplied to the electric device through the output unit 120 of the plug 100, so that is electrically charged in the condenser unit 160.

Figure 4B:
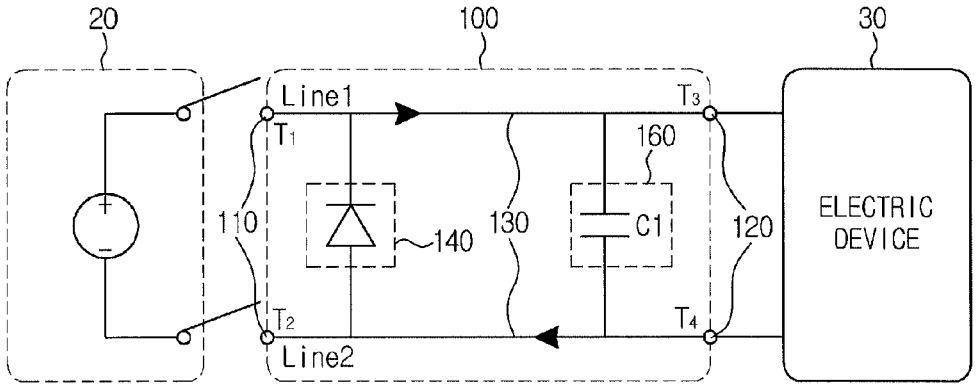
FIG. 4B shows the flow of current in a current-leakage prevention circuit in case of an unplugging operation.

Referring to FIG. 4B, if the plug is plugged out of the socket 20, the input unit 110 of the plug 110 is opened, so that the applying of DC voltage is interrupted.

If the applying of DC voltage is interrupted, the rectifier unit 140 is not applied to the electric device 30, and a residual current of the plug 100 flows in a predetermined direction. That is, the rectifier unit 140 enables the residual current caused by the unplugging operation to flow back to the inside of the plug 100, so that the residual current is consumed in the plug 100 and the electric device 30.

As a result, the arc phenomenon generated when the residual current of the plug 100 is leaked outside through the input unit 110 is prevented from being generated.

In addition, the condenser unit 160 charged with voltage is discharged in the case of the plug-out operation.

In more detail, in the case where the plug 100 is unplugged, a voltage of the input unit 110 of the plug 100 is identical to a voltage of the output unit 120 by a charge voltage charged in the condenser unit 160. By the condenser unit 160, a discharge current is leaked to the electric device 30 with lapse of time, so that a charging potential of the condenser unit 160 is reduced. As a result, the arc phenomenon problem, caused by a difference in electric potential between the input unit and the output unit when the plug is unplugged, can be solved.

Figure 5:
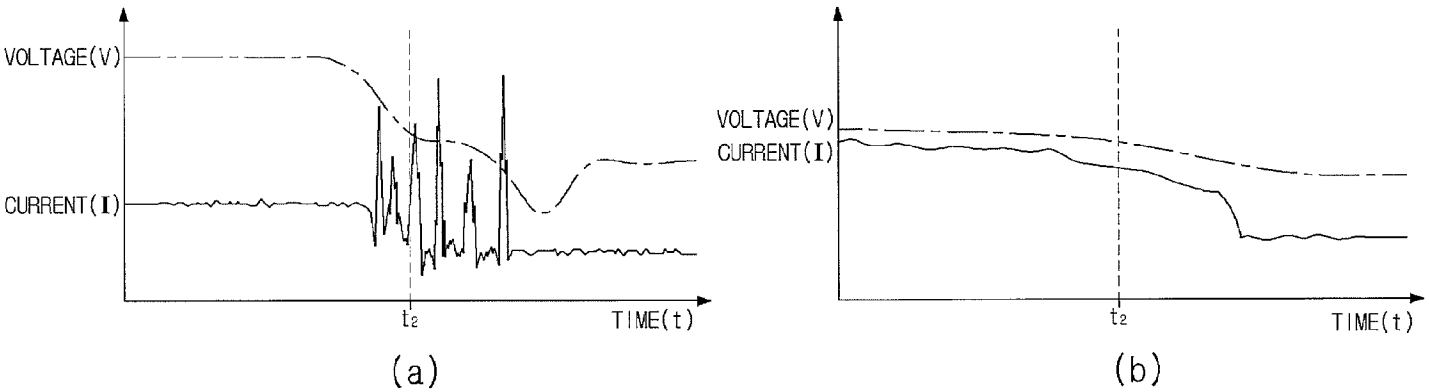
FIG. 5, parts (a) and (b), shows a current changing with time in case of a plug-out operation of one plug including a current-leakage prevention circuit or another plug including no current-leakage prevention circuit.

FIG. 5, part (a), shows a current variation with lapse of time when a plug that does not include the rectifier unit and the condenser unit is unplugged, and FIG. 5, part (b), shows a current variation with lapse of time when a plug including the rectifier unit and the condenser unit is unplugged.

Referring to FIG. 5, part (a), as a voltage (denoted by a chain line) of the plug is reduced from the beginning of the unplugging time ($t_2$) of the plug including no rectifier unit and no condenser unit, a current (denoted by a solid line) is abruptly changed, resulting in the occurrence of arc.

In contrast, referring to FIG. 5, part (b), a current (denoted by a solid line) of the plug including the rectifier unit and the condenser unit is stably reduced along with a plug voltage (denoted by a chain line) that begins to reduce from the beginning of the unplugging time ($t_2$), so that the arc problem can be solved.

The flow of a current of a DC power distribution circuit according to an embodiment of the present disclosure will hereinafter be described with reference to FIGS. 6A and 6B.

Figure 6A:
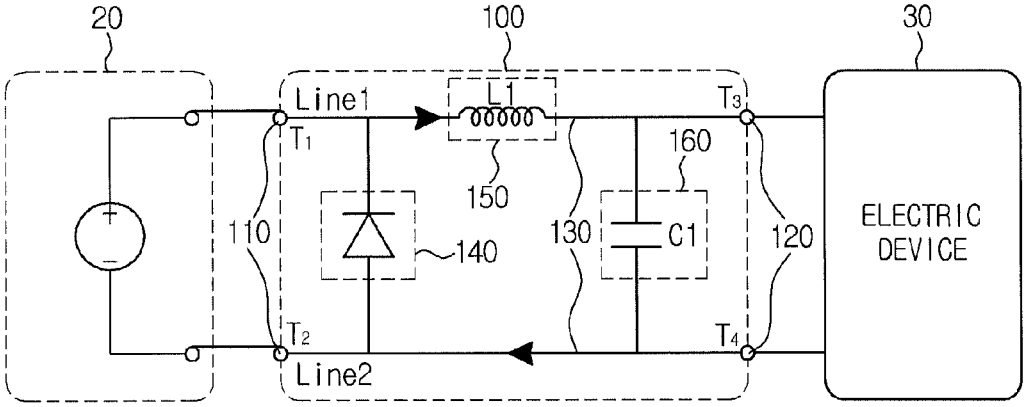
FIG. 6A shows the flow of current in case of a plug-in operation of the plug of the DC appliance shown in FIG. 2.

Referring to FIG. 6A, both terminals of the input unit 110 and the socket 20 of the plug 100 are coupled to each other. If a DC voltage is applied to the plug 100, a current flows from the input unit 110 to the output unit 120 such that it moves to the electric device 30 coupled to the output unit 120.

In this case, the inductor unit 150 is charged with a current so that an internal current of the plug 100 is linearly increased, a voltage is charged in the condenser unit 160 by the current passing through the inductor unit 150, so that the resultant current is output to the output unit 120.

If a predetermined time has elapsed after the inductor unit 150 starts charging, a charging current of the inductor unit 150 is saturated so that the inductor 100 is used as a conductive line and constant current flows in the entirety of the conductive line of the plug 100.

Therefore, it is prevented that an internal current of the plug 100 is abruptly increased by the inductor unit 150. The higher the inductance L1 of the inductor unit 150, the greater the in-rush current prevention effect.

The inductance L1 is the ratio of back electromotive force (back-EMF) generated by electromagnetic induction in response to a variation of current flowing in the circuit, or the ratio of a time variance of a current flowing in a wire to a backelectromotive force generated in the wire. If the inductance L1 is increased, a current charging speed of the inductor unit 150 is reduced. In other words, this means that a time consumed until a current passing through the inductor 110 reaches a saturation current is increased.

Figure 6B:
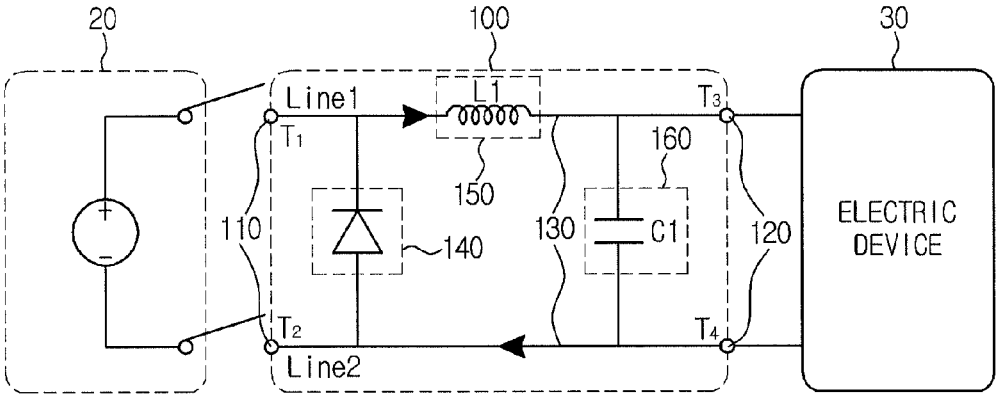
FIG. 6B shows the flow of current in case of an unplugging operation of the plug of the DC appliance shown in FIG. 2.

Under the condition that an internal current of the plug 100 reaches a constant or steady state because a predetermined time has elapsed upon completion of the plug-in operation, if the plug is pulled out of the socket (i.e., the unplugged state as shown in FIG. 6B), the rectifier unit 121 flows back the internal current of the plug to the output unit 120.

The internal current of the plug 100 includes not only a current that is not yet applied from the plug 100 to the electric device 30 in case of the unplugging operation, but also a current charged in the inductor unit 150 due to a voltage variation (voltage drop) generated by the unplugging operation.

In more detail, the rectifier unit 140 rectifies the flow of a current flowing an anode terminal to a cathode terminal of the rectifier unit 140 so as to prevent the internal current of the plug 100 from being leaked to outside through the input unit 110 of the plug 100. That is, the internal current of the plug 100 first flows in the plug 100 and is then output to the electric device 30.

In addition, upon completion of the unplugging operation, the condenser unit 160 discharges a charged voltage so that the current flows in the output unit 120. As a result, the charged voltage drop occurs in the condenser unit 160.

Capacitance C1 of the condenser unit 160, in case of the unplugging operation, may be adjusted for arc prevention in such a manner that a voltage between the input unit 110 and the output unit 120 of the plug is uniformly maintained for a predetermined time so that the arc is not generated.

However, provided that the capacitance C1 is excessively adjusted, the tendency of voltage accumulation of the condenser unit 160 becomes stronger so that it may cause an in-rush current to occur in the plug-in operation. Accordingly, it is preferable that capacitance C1 be properly adjusted.

In the DC-appliance plug 100 according to the embodiment of the present disclosure, the rectifier unit 140 and the condenser unit 160 are arranged in the DC-appliance plug 100, so that the arc phenomenon is not generated when the plug 100 is pulled out of the socket.

In addition, an additional inductor unit 150 is included in the plug 100, such that it can prevent the occurrence of an in-rush current that may be generated when the plug 100 is inserted into the socket (i.e., in case of the plug-in operation).

Therefore, durability of the electric device, plug, and conductive lines can be improved only through simple circuit configuration, and a user can safely use DC current.

Figure 7:
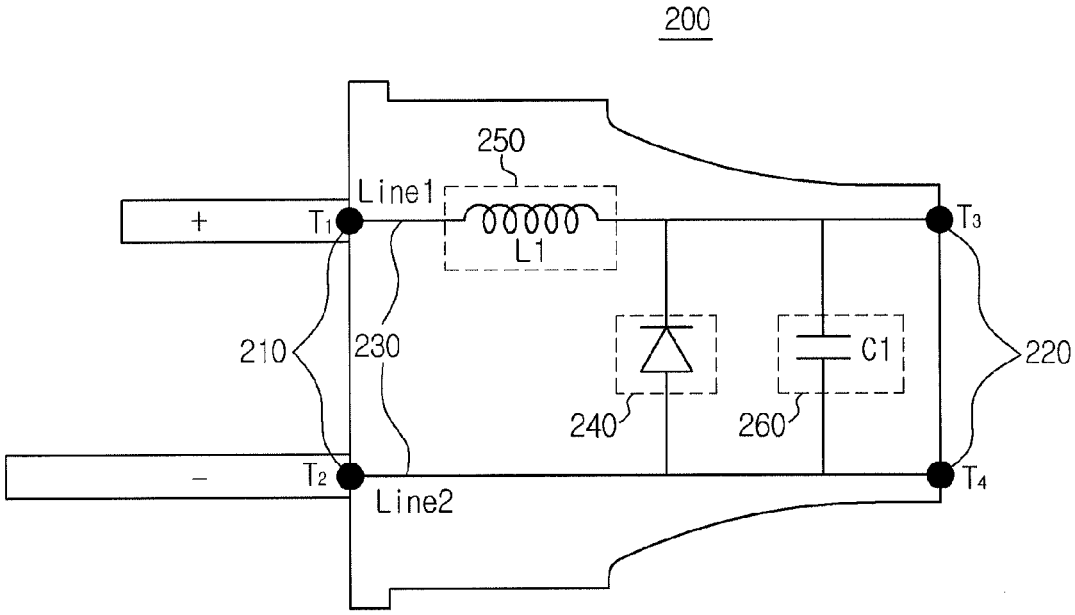
FIG. 7 is a circuit diagram illustrating a plug for a DC appliance according to another embodiment of the present disclosure.

FIG. 7 is a circuit diagram illustrating a plug for a DC appliance according to another embodiment of the present disclosure.

Referring to FIG. 7, the DC-appliance plug 200 according to the embodiment of the present disclosure includes an input unit 210 that includes an anode terminal T1 and a cathode terminal T2 located below the anode terminal T1; an output unit 220 to output an input DC current through an anode terminal T3 and a cathode terminal T4 located below the anode terminal T3; a connection unit 230 that includes an anode line (Line1) and a cathode line (Line2) to interconnect the input unit 210 and the output unit 220; a rectifier unit 240 to rectify a current flowing in a DC power distribution circuit in a predetermined direction; an inductor unit 250 to prevent a current from being abruptly changed by linearly increasing a current flowing in the DC power distribution circuit; and a condenser unit 260 that is changed with voltage in response to a current passing through the inductor unit 250 and discharges the charged voltage through the output unit 220.

Specifically, the DC-appliance plug 200 according to the embodiment of the present disclosure includes the rectifier unit 240 and the condenser unit 260 that are connected in parallel to each other.

In more detail, the cathode terminal of the rectifier unit 240 is located on the anode line (Line1), and the anode terminal is located on the cathode line (Line2).

The rectifier unit 240 is coupled in parallel to the condenser unit 260 coupled between the third terminal T3 and the fourth terminal T4 of the output unit 220. That is, the cathode terminal of the rectifier unit 240 is coupled to the anode terminal T3 of the output unit 220, and the anode terminal thereof is coupled to the cathode terminal T4 of the output unit 220.

In addition, according to this embodiment, the inductor unit 250 is connected in series to the rectifier unit 240 and the condenser unit 260 that are coupled in parallel to each other.

One terminal of the inductor unit 250 is coupled to the anode terminal T1 of the input unit 210, and the other terminal thereof is coupled to the rectifier unit 240 and the condenser unit 260 that are coupled in parallel to each other. That is, the inductor unit 250 is coupled to the input side, and the rectifier unit 240 and the condenser unit 260 are coupled to the output side.

In more detail, one terminal of the inductor unit 250 is coupled to the anode terminal T1 of the input unit 210, and the other terminal thereof is coupled to the cathode terminal of the rectifier unit 240.

Besides, the effect of preventing the in-rush current of the DC-appliance plug 200 simultaneously while preventing the arc problem is identical to that of the above-mentioned description, and as such a detailed description thereof will herein be omitted for convenience of description.

Figure 8:
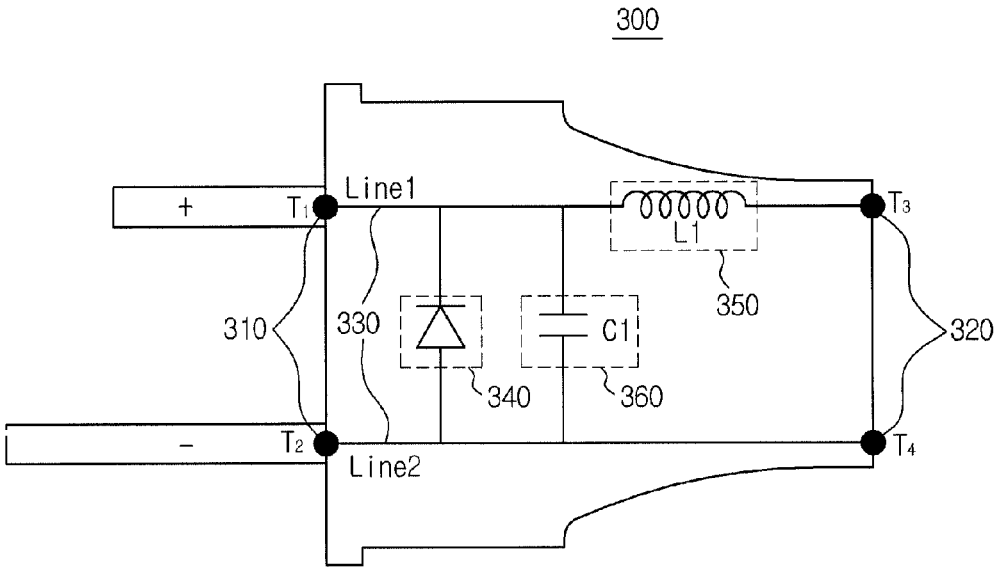
FIG. 8 is a circuit diagram illustrating a plug for a DC appliance according to still another embodiment of the present disclosure.

FIG. 8 is a circuit diagram illustrating a plug for a DC appliance according to still another embodiment of the present disclosure.

Referring to FIG. 8, the DC-appliance plug 300 according to the embodiment of the present disclosure includes an input unit 310 that includes an anode terminal T1 and a cathode terminal T2 located below the anode terminal T1; an output unit 320 to output an input DC current through an anode terminal T3 and a cathode terminal T4 located below the anode terminal T3; a connection unit 330 that includes an anode line (Line1) and a cathode line (Line2) to interconnect the input unit 310 and the output unit 320; a rectifier unit 340 to rectify an internal current of the plug 300 in a predetermined direction; an inductor unit 350 to prevent an internal current from being abruptly changed by linearly increasing an internal current of the plug 300; and a condenser unit 360 that is changed with voltage in response to a current passing through the inductor unit 350 and discharges the charged voltage through the output unit 320.

Specifically, the DC-appliance plug 300 according to the embodiment of the present disclosure includes the rectifier unit 340 and the condenser unit 360 that are connected in parallel to each other.

In more detail, the cathode terminal of the rectifier unit 340 is located on the anode line (Line1), and the anode terminal is located on the cathode line (Line2).

The rectifier unit 340 is coupled in parallel to the condenser unit 360, and is coupled to the input unit 310. That is, the cathode terminal of the rectifier unit 340 is coupled to the anode terminal T1 of the input unit 310, and the anode terminal thereof is coupled to the cathode terminal T2 of the input unit 310.

In addition, according to this embodiment, the inductor unit 350 is connected in series to the rectifier unit 340 and the condenser unit 360 that are coupled in parallel to each other.

One terminal of the inductor unit 350 is coupled to the anode terminal T3 of the output unit 320, and the other terminal thereof is coupled to the rectifier unit 340 and the condenser unit 360 that are coupled in parallel to each other. That is, the inductor unit 350 is located on the anode line (Line1), so that it is coupled to upper terminals of the condenser unit 360 and the condenser unit 360 that are coupled in parallel to each other.

Besides, the effect of preventing the in-rush current simultaneously while preventing the arc problem is identical to that of the above-mentioned description, and as such a detailed description thereof will herein be omitted for convenience of description.

As is apparent from the above description, according to the above-mentioned plug for the DC appliance of the embodiment of the present disclosure, a rectifier and a condenser are arranged in the plug for the DC appliance, so that the embodiment can prevent the occurrence of arc that may be generated when a plug is pulled out of an outlet.

In addition, an inductor is additionally arranged in the plug of the DC appliance, so that an in-rush current that may be generated when a plug is put into an outlet is prevented from being generated.

As a result, durability of the electric device, plug, and conductive lines can be improved only through simple circuit configuration, and a user can safely use DC current.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A plug for a DC appliance comprising:

an input unit including anode and cathode terminals insertable into a socket so as to receive an input DC current;

an output unit including anode and cathode terminals so as to allow the input DC current input through the input unit to be output to an electric device;

a connection unit including anode and cathode lines, the connection unit being configured to interconnect the input unit and the output unit;

an inductor unit coupled between the input unit and the output unit, the inductor unit being configured to gradually increase an internal current of the plug in response to an increase of the input DC current;

a rectifier unit coupled between the anode and the cathode terminals of the input unit and connected to one terminal of the inductor unit, to rectify the input DC current, and to flow back a current present in the plug to the output unit when the input DC current is stopped by the input unit; and a condenser unit coupled between the anode and the cathode terminals of the input unit, the condenser unit being connected to the one terminal of the inductor unit, to charge voltage in response to a current passing through the inductor unit, and to discharges the charged voltage to the output unit when the input DC current from the input unit is interrupted.

2. The plug according to claim 1, wherein the rectifier unit prevents an arc phenomenon when the input DC current is stopped by the input unit, by flowing back a current present in the plug to the output unit.

3. The plug according to claim 1, wherein the inductor unit prevents flow of an in-rush current when the input unit is inserted into the socket, by preventing the internal current of the plug from being rapidly increased when the input DC current is increased.

4. The plug according to claim 1, wherein the condenser unit prevents an arc phenomenon when the input DC current is stopped by the input unit, by reducing a voltage difference between the input unit and the output unit.

* * * * *